US008146754B2

(12) United States Patent
Apgood, II et al.

(10) Patent No.: US 8,146,754 B2
(45) Date of Patent: Apr. 3, 2012

(54) STORAGE AND ORGANIZATION SYSTEM

(75) Inventors: William G. Apgood, II, Holladay, UT (US); Lenny Vainberg, Mission Viejo, CA (US); William G. Apgood, Holladay, UT (US); Robert Glenn, Chicago, IL (US)

(73) Assignee: Red Star Traders, LLC, Salt Lake City, UT (US)

( * ) Notice: Subject to any disclaimer, the term of this patent is extended or adjusted under 35 U.S.C. 154(b) by 463 days.

(21) Appl. No.: 12/328,761

(22) Filed: Dec. 4, 2008

(65) Prior Publication Data

US 2009/0145867 A1 Jun. 11, 2009

Related U.S. Application Data

(60) Provisional application No. 61/012,344, filed on Dec. 7, 2007.

(51) Int. Cl.
*A47F 5/08* (2006.01)

(52) U.S. Cl. ..... 211/94.01; 211/7; 211/59.1

(58) Field of Classification Search ..... 211/94.01, 211/57.1, 59.1, 54.1, 7; 248/220.21, 222.51, 248/223.31, 223.41, 304
See application file for complete search history.

(56) References Cited

U.S. PATENT DOCUMENTS 1,803,016 A * 4/1931 Harsted ..... 248/220.43
3,337,172 A 8/1967 Jackson
3,362,768 A 1/1968 Fink
3,634,983 A 1/1972 Welch
D241,396 S 9/1976 Copeland
4,094,415 A * 6/1978 Larson ..... 211/57.1
4,165,852 A 8/1979 Chervenak
4,279,397 A 7/1981 Larsson
4,308,961 A * 1/1982 Kunce ..... 211/94.01
4,398,639 A 8/1983 Daniels
4,420,087 A 12/1983 Johns
4,452,360 A 6/1984 Barnes
4,591,058 A * 5/1986 Amstutz et al. ..... 211/94.01
4,607,753 A * 8/1986 Radek ..... 211/94.01
4,615,448 A * 10/1986 Johnstonbaugh ..... 211/94.01
4,618,192 A * 10/1986 Kelley ..... 312/245
4,629,076 A * 12/1986 Amstutz et al. ..... 211/94.01
4,678,151 A * 7/1987 Radek ..... 248/223.41
4,720,622 A 1/1988 Iwata et al.

(Continued)

OTHER PUBLICATIONS

*Materials from www.newageproducts.com*; Downloaded Jun. 3, 2008; 9 pages.

(Continued)

*Primary Examiner* — Darnell Jayne
*Assistant Examiner* — Sasha T Varghese
(74) *Attorney, Agent, or Firm* — Workman Nydegger

(57) ABSTRACT

A storage and/or organization system may be used to store and/or organize various items. For example, the system may include one or more panels and one or more attachment members, which may be connected to the panels and may be used to hold and/or position various items in desired locations. The attachment members may be selectively connected to and/or removed from the panels to provide a variety of storage and organization solutions. The panels may include, for example, one or more receiving portions to which the attachment members may be connected to and/or disconnected from using a snap, friction and/or interference fit. One or more portions of the panels and/or the attachment members may deform and/or deflect to provide the snap, friction and/or interference. One or more portions of the panels and/or the attachment members may remain deformed and/or deflected to provide a tension fit.

19 Claims, 6 Drawing Sheets

U.S. PATENT DOCUMENTS 4,726,554 A * 2/1988 Sorrell ..... 248/222.51
4,753,355 A 6/1988 Hall et al.
4,826,115 A 5/1989 Novitski
4,928,833 A 5/1990 Huizenga
5,121,578 A 6/1992 Holz
5,138,803 A * 8/1992 Grossen ..... 52/36.4
5,222,611 A 6/1993 Wood et al.
D338,076 S 8/1993 Current
5,348,167 A * 9/1994 Jensen ..... 211/57.1
5,711,115 A 1/1998 Wirt
5,718,493 A 2/1998 Nikolai
D393,907 S 4/1998 Current
D395,089 S 6/1998 Current
D395,456 S 6/1998 Ito et al.
D399,010 S 9/1998 Current
D399,012 S 9/1998 Current
D400,270 S 10/1998 Current
5,819,490 A * 10/1998 Current ..... 52/588.1
5,819,958 A 10/1998 Dement
D403,085 S 12/1998 Current
5,848,711 A 12/1998 Schmit
D404,148 S 1/1999 Laskowski et al.
5,899,344 A * 5/1999 Current et al. ..... 211/94.01
5,941,026 A 8/1999 Eisenreich et al.
5,944,203 A * 8/1999 Vlah et al. ..... 211/189
5,944,294 A * 8/1999 Baer ..... 248/220.43
D414,567 S 9/1999 Burt et al.
5,983,574 A 11/1999 Holztrager
6,050,426 A * 4/2000 Leurdijk ..... 211/94.01
6,113,201 A 9/2000 Bauer
6,119,878 A * 9/2000 Zen ..... 211/94.01
6,128,843 A 10/2000 Gebka
6,134,846 A * 10/2000 Lamb ..... 52/36.5
6,223,915 B1 5/2001 Waner
6,286,802 B1 9/2001 Munson et al.
6,325,223 B1 12/2001 Hannen
6,393,877 B1 5/2002 Church
6,491,172 B2 * 12/2002 Chance et al. ..... 211/87.01
D473,664 S 4/2003 Perkins et al.
6,578,498 B1 6/2003 Draudt et al.
D482,802 S 11/2003 Yates, Jr.
D482,803 S 11/2003 Yates, Jr.
6,659,295 B1 12/2003 De Land et al.
D494,842 S 8/2004 Perkins et al.
6,811,043 B2 11/2004 Perkins et al.
6,926,159 B1 * 8/2005 Cash et al. ..... 211/57.1
6,926,160 B2 8/2005 Perkins et al.
6,971,614 B2 12/2005 Fischer et al.
7,055,703 B2 6/2006 Perkins et al.
7,083,056 B2 8/2006 Routhier
7,104,023 B1 9/2006 Holztrager
D532,120 S 11/2006 Holztrager
D533,283 S 12/2006 Holztrager
7,147,115 B2 12/2006 Perkins et al.
7,175,034 B2 2/2007 Nook et al.
7,228,977 B2 6/2007 Perkins et al.
D549,563 S 8/2007 Browne et al.
D552,687 S 10/2007 Smalley
7,296,695 B2 11/2007 Perkins et al.
7,360,661 B2 4/2008 Nickerson
D583,965 S 12/2008 Castellanos
D605,103 S 12/2009 Schuephaus et al.
D611,272 S 3/2010 Daino
7,686,172 B2 3/2010 Wisnoski et al.
D613,520 S 4/2010 Goodman
7,717,279 B2 5/2010 Lawson
D617,583 S 6/2010 Daino
D619,881 S 7/2010 Shaha et al.
7,753,217 B2 7/2010 Lawson
7,757,869 B2 7/2010 Lawson
7,798,463 B2 9/2010 Morgenroth
7,806,279 B2 10/2010 Kubota
D627,179 S 11/2010 Fabiano et al.
7,891,617 B2 2/2011 Tisbo
D633,315 S 3/2011 Fabiano et al.
7,938,279 B2 5/2011 Kaplan
D648,448 S 11/2011 Apgood
D649,267 S 11/2011 Apgood
2002/0104813 A1 8/2002 Routhier
2003/0189019 A1 * 10/2003 Campbell et al. ..... 211/94.01
2004/0108288 A1 * 6/2004 Breymaier et al. ..... 211/94.01
2004/0124164 A1 7/2004 Perkins et al.
2005/0006539 A1 * 1/2005 Fischer et al. ..... 248/220.42
2005/0029210 A1 2/2005 Perkins et al.
2005/0247653 A1 11/2005 Brooks
2006/0091094 A1 * 5/2006 Schuberth ..... 211/94.01
2006/0180561 A1 * 8/2006 Wisnoski et al. ..... 211/94.01
2007/0012636 A1 * 1/2007 Wisnoski et al. ..... 211/70.6
2007/0181517 A1 8/2007 Perkins et al.
2007/0221594 A1 9/2007 Pierro
2008/0047910 A1 2/2008 Kubota

OTHER PUBLICATIONS

*Materials from www.newageproducts.com*; Downloaded Sep. 18, 2008; 14 pages.

*Welcome to HandiSolutions™*; URL: http://web.archive.org/web/20060915195547/http://www.handiwall.com/; 2 pages.[1], Sep. 2006.

USPTO, Notice of Allowance dated May 26, 2011 from U.S. Appl. No. 29/329,011 (7 pages).

ISA-USPTO, International Search Report and Written Opinion dated Jul. 7, 2010 from PCT Patent Application No. PCT/US2010/034305 (11 pages).

ISA-USPTO, International Search Report and Written Opinion dated Feb. 12, 2009 from PCT Patent Application No. PCT/US2008/085687 (7 pages).

USPTO, Office Action dated May 24, 2011 from U.S. Appl. No. 29/329,009 (6 pages).

USPTO, Office Action U.S. Appl. No. 12/775,732, mailed Dec. 7, 2011, 10 pages.

* cited by examiner

STORAGE AND ORGANIZATION SYSTEM

CROSS-REFERENCE TO RELATED APPLICATIONS

This application claims priority to and the benefit of U.S. provisional patent application Ser. No. 61/012,344, filed Dec. 7, 2007 and entitled WALL SYSTEM, which is incorporated by reference in its entirety.

BACKGROUND OF THE INVENTION

1. Field of the Invention

The present invention generally relates to storage and/or organization systems and, in particular, to wall mounted storage and/or organization systems such as a slat wall.

2. Description of Related Art

Several different types of wall mounted storage and display systems are known. For example, pegboard is commonly attached to a wall and specially designed hooks may be attached to the pegboard. The hooks may be used to attach or hold various items in a fixed position relative to the pegboard. Disadvantageously, many conventional pegboard systems can only support a limited number of items and a limited amount of weight without damaging the pegboard. In addition, the hooks used with many conventional pegboard systems may inadvertently be removed or dislodged, which may allow items to fall and break. It is known to use fasteners to help secure the hooks to the pegboard, but these fasteners require additional time to install and often offer limited assistance in keeping the hook attached to the pegboard. Further, because pegboard is typically constructed from relatively weak materials such as fiberboard or particle board, conventional pegboard cannot support significant loads and the pegboard may fail if too much weight is placed on the hooks.

In addition, because pegboard is typically constructed from wood, the pegboard is often heavy. However, because the peg board is usually constructed from thin sheets of wood, the pegboard can be brittle and easily broken. Further, if the pegboard is broken or damaged, it may be difficult and time consuming to repair. Finally, because pegboard is usually constructed from wood, it is subject to moisture damage and often requires painting or staining to help protect the wood.

A slat wall is another type of storage and organization system. Slat wall systems typically include a panel with a series of generally horizontal grooves or channels that run along the length of the panel, providing a slatted appearance. Typically, hooks may be selectively connected to and disconnected from the grooves, and items may be placed onto the hooks for storage. The hooks may be used to support a variety of objects such as tools in a workroom or garage to products that are on display in a retail store.

Conventional slat wall systems may allow the hooks to be placed in a variety of desired positions relative to the panel. The hooks of many known slat wall systems, however, can be unintentionally dislodged from the panels by inadvertent contact. In addition, when items are removed from the hooks of many conventional slat wall systems, the hooks can be unintentionally dislodged from the panels.

Additionally, the panels of some conventional slat wall systems may be made from relatively heavy materials such as particle board, plywood, or fiberboard. This may undesirably increase the weight of the panels, which may make the panels more difficult to install and the slat wall system more expensive to ship. In addition, the wooden panels may become brittle, tending to crack or split. The wooden panels may also be difficult and time consuming to replace and/or repair, and often require periodic maintenance. Further, the wooden panels may be able to support only a limited amount of weight without breaking or being permanently damaged.

BRIEF SUMMARY OF EMBODIMENTS OF THE INVENTION

A need therefore exists for a system that eliminates or diminishes the disadvantages and problems described above.

One aspect is a storage and organization system that may be used to store and/or organize various items. For example, the storage and organization system may include one or more panels and various types of attachment members (which may include hooks, braces, brackets, racks, cabinets and the like) that may be connected to the panels, and these structures may be used to hold and/or position various items in desired locations. Advantageously, these structures may be selectively connected to and/or removed from the panels, if desired.

Another aspect is a storage and organization system that may include one or more panels and one or more attachment members that are sized and configured to be connected to the panels. The panels may include, for example, one or more elongated receiving portions (such as elongated slots, channels, grooves or the like) that are sized and configured to receive, retain and/or engage at least a portion of the attachment member.

Still another aspect is a panel for a storage and organization system that may include one or more receiving portions. The receiving portions are preferably elongated and include a recess that is disposed at an angle relative to the front of the panel. In some instances, the recess may be disposed at an angle between about 40 degrees and about 50 degrees. The recess may also be disposed at other angles such as between about 35 degrees and about 55 degrees relative to the front of the panel. The recess may also be disposed at angles such as about 45 degrees relative to the front of the panel.

Yet another aspect is an attachment member for a storage and organization system that may include one or more engaging members, such as a spring. The engaging members may be sized and configured to deform and/or deflect as the engaging member is inserted into and/or withdrawn from a receiving portion of a panel. The engaging members may assist in securely attaching the attachment members to the panels. The engaging members may also help provide a snug fit with the receiving portion. In addition, when the engaging member is within the receiving portion, the engaging member may remain at least partially deformed and/or deflected, which may help provide a more secure fit or attachment of the attachment member to the panel.

A further aspect is a storage and organization system that may include panels and/or walls. For example, if the system includes walls, then the walls may include one or more receiving portions that are sized and configured to receive, retain and/or engage one or more attachment members. The walls may be connected to a support wall or other support structure, and the walls may be connected to or disposed in other structures such as a cabinet. For example, the walls may form part of the cabinet or be disposed in the cabinet. In particular, the walls may form a rear wall and/or side walls of the cabinet. The walls, however, may be simply disposed inside the structure such as a cabinet.

A still further aspect is a storage and organization system that may include a wall which is used in connection with a cabinet. The cabinet, however, may not require a rear wall because the rear wall may be formed by the wall of the storage and organization system. For example, the cabinet may include a pair of side walls, upper and lower walls and one or more doors. This may allow the cabinet to be connected to the wall of the storage and organization system such that at least a portion of the wall is accessible when the doors of the cabinet are opened. Preferably the wall includes receiving portions and these receiving portions are accessible when the doors of the cabinet are open.

Yet another further aspect is a storage and organization system that may include one or more panels. The panels may be interconnected by one or more connectors. The connectors may allow the panels to be securely connected and may allow the receiving portions in the panels to be aligned. Thus, the panels may be connected to form a system of any desired sized. In addition, the connectors may be used in connection with panels that are cut to a desired size. This may allow the storage and organization system to be used in a wide variety of situations and environments.

Still yet another further aspect is a storage and organization system that includes panels constructed from strong and/or durable materials such as PVC plastic. The plastic panels may be formed by various processes such as extrusion molding, injection molding and other suitable molding processes. Other components of the system may also be formed from strong and/or durable materials such as PVC plastic. For example, the connectors that may be used to interconnect the panels may be constructed from plastic. The connectors and other components of the system may also be constructed from other suitable materials such as wood and the like.

Another aspect is a storage and organization system that may include a plurality of panels which are capable of being aligned. In order to assist in the alignment of the panels, alignment members may be used. For example, the panels may include receiving portions that are sized and configured to receive an alignment member (such as a dowel pin) to help align the panels. If desired, the receiving portions may be integrally formed in the panels during the manufacturing process. For instance, if the panels are constructed from molded plastic, then the receiving portions may be integrally formed with the panels as part of a unitary, one-piece structure. In addition, the alignment members may be used to connect the panels. Thus, the same structures may be used to align and connect the panels. Different structures, however, could be used to align and connect the panels.

Still another aspect is a storage and organization system that may include panels with receiving portions that extend across a width of the panels. The receiving portions are preferably vertically spaced apart by a distance. In addition, the receiving portions are preferably spaced apart from the upper and lower edges of the panels by a distance. The distances separating the receiving portions are preferably a constant distance. In addition, if another panel is spaced above or below another panel, the receiving portions are preferably spaced apart by the same constant distance. Thus, the distance separating the receiving portions in a given panel and adjacent panels may be separated by the same distance. Therefore, because the spacing between receiving portions in a panel and adjacent panels may be the same distance, this may allow attachment members to be attached to a panel and/or adjacent panels.

Yet another aspect is a storage and organization system that may include panels with receiving portions that are specifically sized and configured to allow attachment members to be attached. These receiving portions may allow the attachment members to be securely attached to the panels. In addition, these receiving portions may allow the attachment members to be selectively attached and removed from the panels. These receiving portions preferably allow the attachment members to be attached to various locations to the panels.

A further aspect is an attachment member that may be used in connection with a storage and organization system. The attachment member may include a base that is connected to a panel and one or more outwardly extending portions that may be sized and configured to support various items or objects such as tools, shelves and the like. Advantageously, the attachment members may have different shapes, sizes, configurations and arrangements depending upon the items or objects to be attached to the system. The attachment members, however, preferably have a similar base to allow various types of attachment members to be attached to a panel. The attachment members may have different outwardly extending portions depending, for example, upon the intended use of the attachments members or storage and organization system.

A still further aspect is an attachment member that may be used with a storage and organization system that includes a first portion that is inserted into a first receiving portion of a panel and a second portion that is inserted into a second receiving portion of a panel. The second portion of the attachment member may include a flexible or resilient portion, if desired.

Another aspect is a storage and organization system that may include an attachment member sized and configured to be connected to and disconnected from a wall, the wall including a first elongated receiving portion and a second elongated receiving portion. The attachment member may include a base with a body including an engaging portion sized and configured to be inserted into and retained by the first elongated receiving portion; and a spring including an engaging portion sized and configured to be inserted into and retained by the second elongated receiving portion using a snap fit; and a support connected to the base.

Yet another aspect is a storage and organization system that may include at least one panel, elongated receiving portions formed in the at least one panel, the elongated receiving portions being at least substantially parallel; and a cabinet connected to at least one of elongated receiving portions. The cabinet may include a first side wall, a second side wall, an upper wall, a lower wall and an open-ended rear that abuts the at least one panel and provides access to at least a part of one or more of the elongated receiving portions behind the cabinet.

A still further aspect is a storage and organization system that may include an attachment member sized and configured to be connected to and disconnected from at least one panel, a first elongated receiving portion being disposed in the at least one panel, a second elongated receiving portion being disposed in the at least one panel, the second elongated receiving portion being at least substantially parallel to the first elongated receiving portion. The attachment member may include a base with a first engaging portion sized and configured to be inserted into and retained by the first elongated receiving portion; and a second engaging portion sized and configured to be inserted into and retained by the second elongated receiving portion using a snap fit. The system may further include a support connected to the base.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards storage and/or organization systems. The principles of the present invention, however, are not limited to storage and/or organization systems. It will be understood that, in light of the present disclosure, the storage and/or organization system, and its associated components and features, disclosed herein can be successfully used in connection with other types of structures, devices and uses.

Additionally, to assist in the description of the storage and/or organization system, words such as top, bottom, front, rear, right and left may be used to describe the accompanying figures, which may be but are not necessarily drawn to scale. It will be appreciated that the storage and/or organization system can also be located in a variety of desired positions and/or orientations. A more detailed description of the storage and/or organization system now follows.

Figure 1:
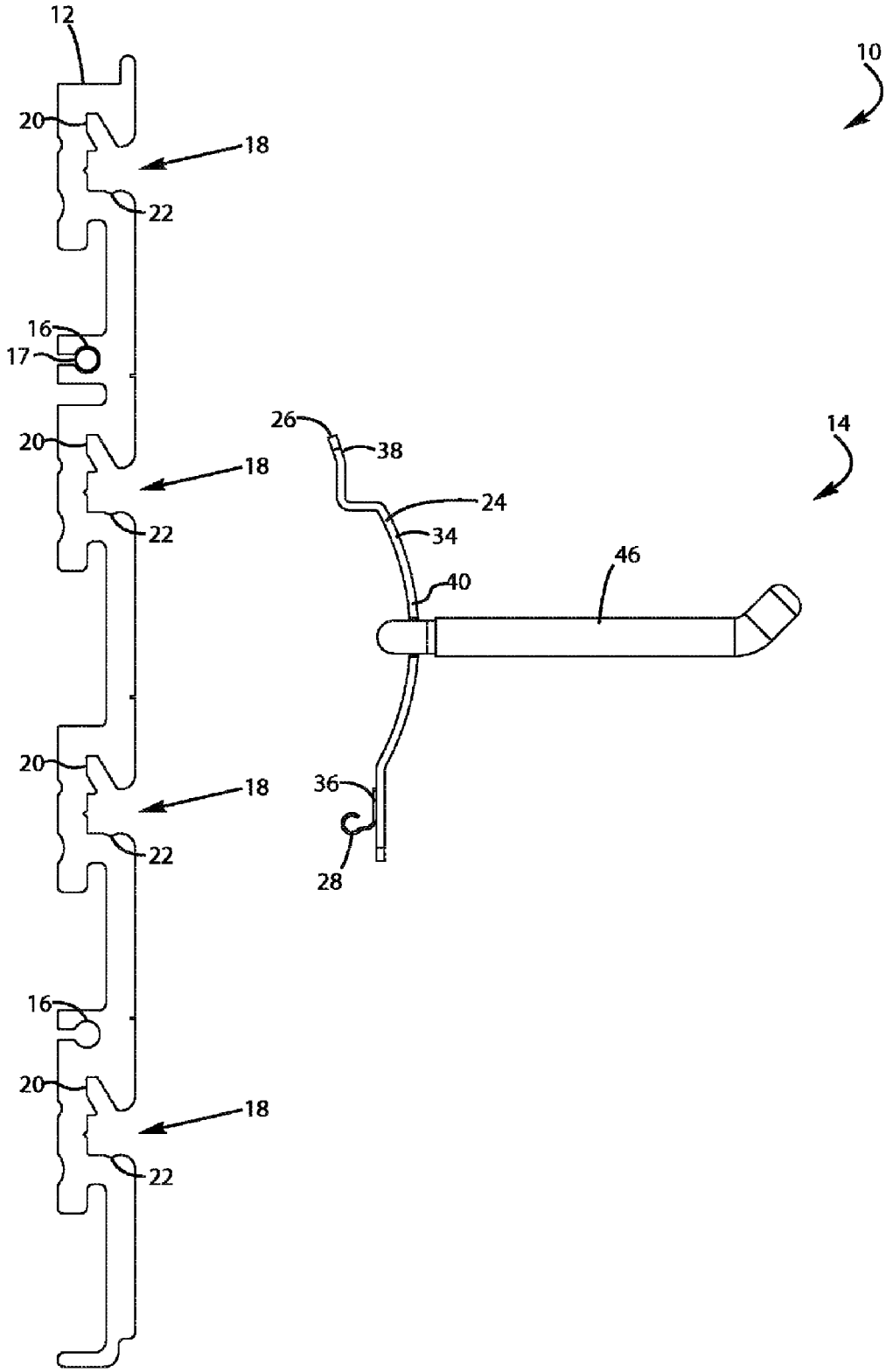
FIG. 1 is side view of an exemplary storage and/or organization system, illustrating a panel and an attachment member.

As shown in FIG. 1, a storage and/or organization system 10 may be used to store and/or organize various items. The storage and/or organization system 10 may be a slat wall type system that allows items to be efficiently stored and organized. The system 10, however, does not have to be a slat wall system and the various components discussed in greater detail below may be used in connection with other suitable types of systems. Further, while the system 10 is discussed below in connection with a number of parts and components that may be interconnected or interact, the parts and components do not have to be used as part of a system. Thus, for example, the parts and components may be used individually or in connection with other systems.

The storage and/or organization system 10 may include one or more panels 12 and one or more attachment members 14. The attachment members 14 may be connected to the panels 12 and may be used to hold and/or position various items in desired locations relative to the panels. For example, the attachment members 14 may be used to attach items or objects such as tools, shelves and the like to the panels 12. Advantageously, the attachment members 14 may be selectively connected to and/or removed from the panels 12. In addition, as discussed in more detail below, the system 10 may include any suitable number of panels 12 and attachment members 14 depending, for example, upon the intended use of the system.

The system 10 may include a single panel 12 or multiple panels, and the panels may be interconnected. The panels 12 may be mounted on or form part of a wall or other suitable structure. The panels 12 may be constructed from a strong and/or durable material (such as PVC plastic) using a molding process such as extrusion molding, injection molding and the like. It will be appreciated, however, that the panels 12 may be constructed from metal, wood (such as particle board, plywood, fiberboard, etc.) or other materials having suitable properties and characteristics. It will also be appreciated that the panels 12 may be constructed using other suitable manufacturing processes.

To help interconnect and/or align adjacent panels 12, the panels may include one or more receiving portions 16 that may be sized and configured to receive an alignment member 17. For example, as shown in FIG. 1, the panels 12 may include two receiving portions 16 and the receiving portions may consist of holes, channels, grooves of the like. The receiving portions 16 preferably include an opening disposed on the sides of the panels 12 and the receiving portions preferably extend along the entire length or width of the panels.

The receiving portions 16 may facilitate positioning the panels in a desired horizontal arrangement. Advantageously, if the receiving portions 16 span the entire length or width of the panels 12, then the panels may be cut to various desired sizes and the receiving portions may still be used to receive an alignment member. This may allow, for example, the system 10 to have a variety of shapes, sizes, configurations and arrangements. It will be appreciated that the receiving portions 16 may also be positioned in other desired locations, if desired.

The alignment members 17 may be used in connection with the receiving portions 16 to align adjacent panels 12. For example, one end of an alignment member 17 may be inserted into a receiving portion 16 in a panel and another end of the alignment member 17 may be inserted into a receiving portion in another panel. This may allow adjacent panels 12 to be aligned. Advantageously, the alignment members 17 may consist of round tubular or cylindrical structures as shown in FIG. 1, such as dowels, rods, pins and the like. It will be appreciated that the alignment members may also have other suitable shapes and sizes, such as square, rectangular and the like. In addition, the alignment members may be used to interconnect adjacent panels 12. For example, if the alignment members are inserted into the receiving portions 16 with a snap, interference or friction fit, then this may facilitate connecting the panels 12. The panels 12 may also be interconnected with other suitable structures such as fasteners, adhesives and the like.

The panels 12 may also include one or more alignment features or structures to help align the panels. For example, the lower portions of the panels may include alignment structures or features that are sized and configured to align with corresponding alignment structures or features in the upper portion of the panels. This may allow the panels to be positioned in a desired position when the panels are vertically aligned.

Figure 8:
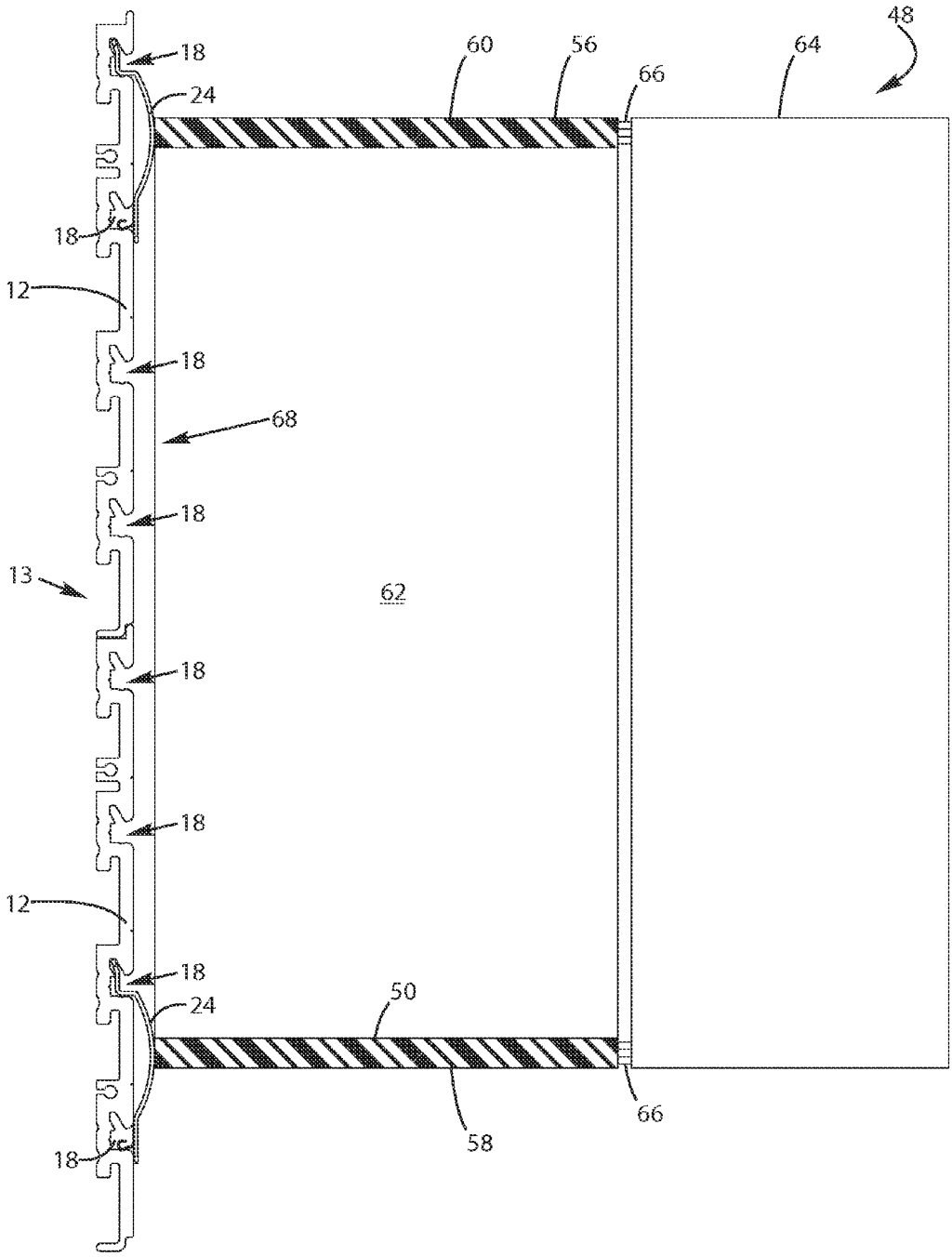
FIG. 8 is a side view of another exemplary storage and/or organization system, illustrating a pair of the panels and a cross section of an exemplary cabinet.

The alignment features or structures may consist of one or more overlapping and/or interlocking portions. For example, the upper and lower portions of the panels 12 may include overlapping and/or interlocking portions, which may allow adjacent panels to be positioned. As shown in FIGS. 1 and 8, the upper portion of the panels 12 may include a generally planar engaging surface and an engaging portion. The lower portion of the panels 12 may include a generally planar engaging surface and a receiving portion. As shown in FIG. 8, when two panels 12 are vertically aligned, the generally planar engaging surfaces may contact or abut, and the engaging portion may be disposed in the receiving portion. This may allow a system 10 with any desired height to be created and it may allow the panels 12 to be spaced apart any desired distance.

If the receiving portions 16 are disposed on the sides of the panels 12 and the overlapping portions are disposed on the top and bottom portions of the panels, that may allow the panels to be disposed a desired horizontal and vertical configuration. It will be appreciated that the receiving portions 16 and overlapping portions may also be disposed in other suitable locations and have different shapes, sizes, configurations and arrangements depending, for example, upon the intended use of the system 10. It will also be understood that the panels 12 do not require receiving portions 16, alignment members, overlapping and/or interlocking portions, etc.

Figure 5:
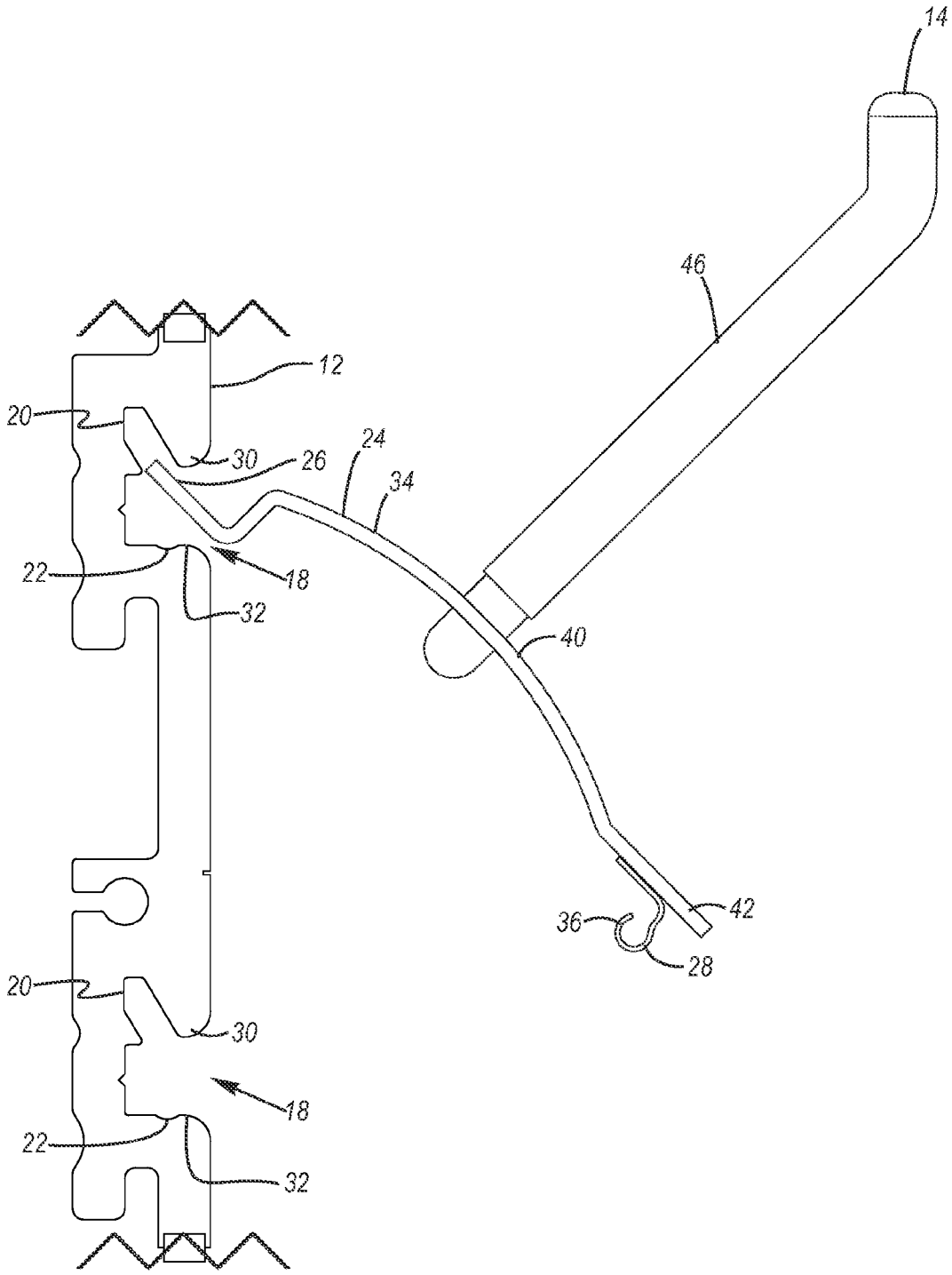
FIG. 5 is an enlarged side view of a portion of the storage and/or organization system shown in FIG. 1, illustrating a portion of the attachment member inserted into a receiving portion in the panel.
Figure 6:
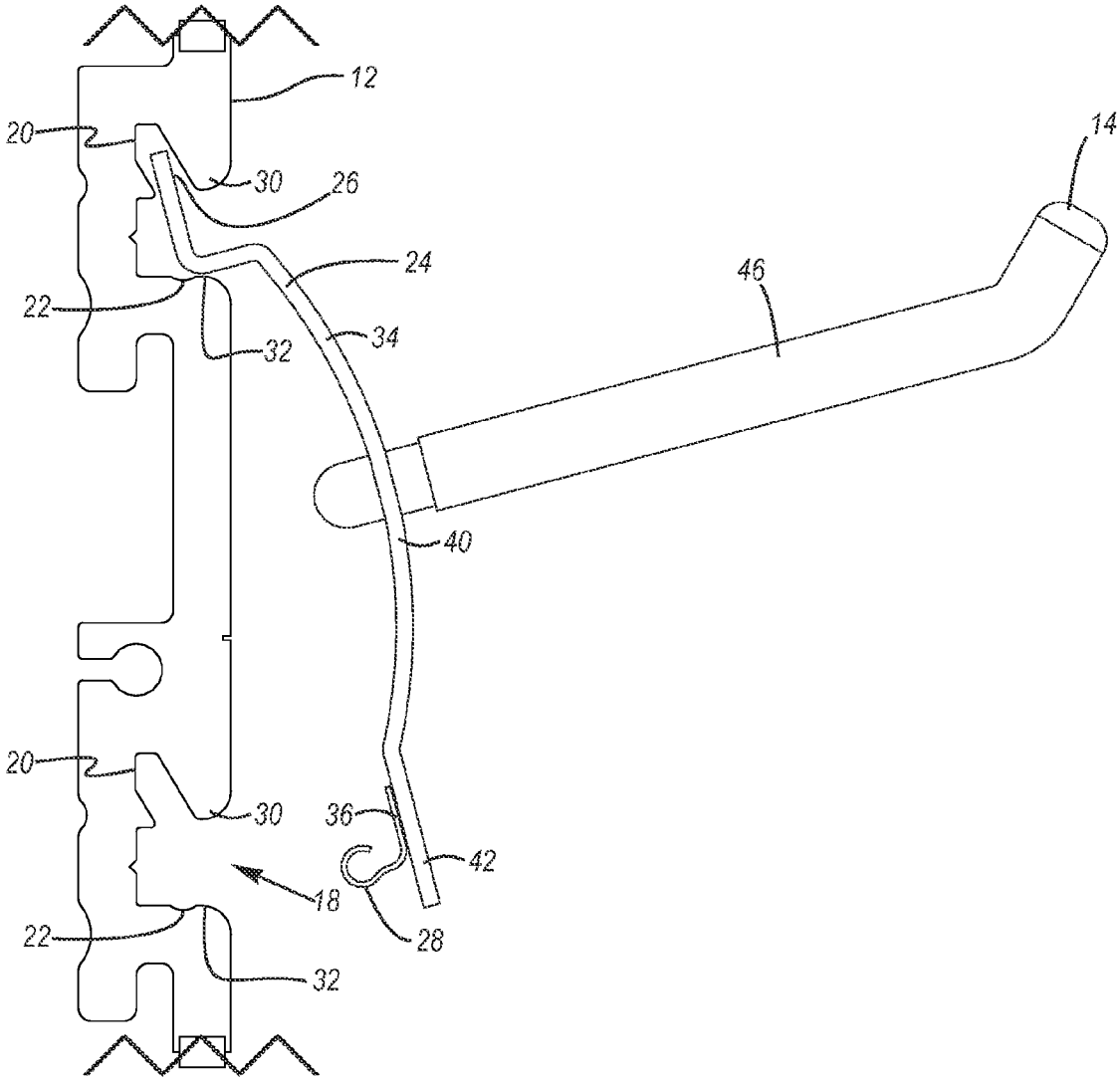
FIG. 6 is a another side view of the portion of the storage and/or organization system shown in FIG. 5, illustrating another exemplary position of the attachment member and the panel.
Figure 7:
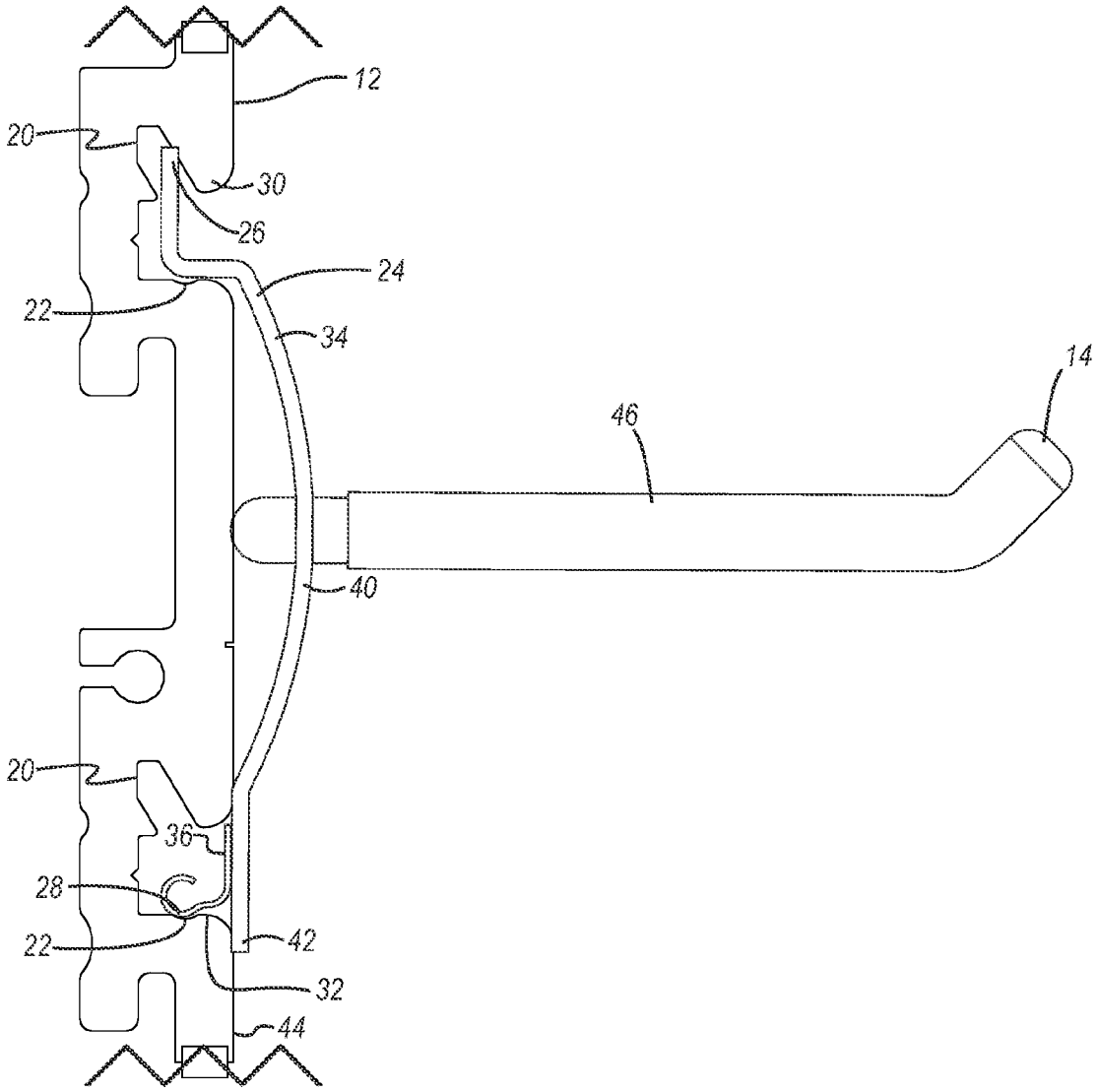
FIG. 7 is yet another side view of the portion of the storage and/or organization system shown in FIG. 5, illustrating yet another exemplary position of the attachment member and the panel.

The panels 12 may also include one or more receiving portions 18 that are sized and configured to allow the attachment members 14 to be attached to the panels. In particular, the receiving portions 18 are preferably sized and configured to receive, retain and/or engage one or more portions of the attachment member 14. The receiving portions 18 may include one or more channels, grooves, recesses and the like, and the receiving portions are preferably formed in the front surface of the panels 12. As best seen in FIGS. 5-7, the receiving portions 18 may include a first recess 20 and a second recess 22 that are sized and configured to receive, retain and/or engage portions of the attachment member 14.

The attachment members 14 may include a base 24 with engaging members 26, 28 that are sized and configured to be inserted into and/or withdrawn from the recesses 20, 22, respectively. For example, as shown in FIGS. 5-7, the engaging member 26 may be inserted into and/or withdrawn from the recess 20 of a first receiving portion 18 and the engaging member 28 may be inserted into and/or withdrawn from the recess 22 of a second receiving portion 18. If desired, the recesses 20, 22 may receive, retain and/or engage the engaging members 26, 28, respectively, using a snap, friction and/or interference fit.

In order to help create the snap, friction and/or interference fit between the receiving portions 18 and the engaging members 26, 28, portions of the attachment members 14 may be flexible and resilient. For example, either or both of the engaging members 26, 28 may deform and/or deflect when inserted into and/or withdrawn from the recesses 20, 22. In addition, portions of the panel 12 may deform and/or deflect when the engaging members 26, 28 are inserted into and/or withdrawn from the recesses 20, 22, which may also help create the snap, friction and/or interference fit. For example, the panel 12 may include outwardly extending protrusions 30, 32 as best seen in FIGS. 5-7. These outwardly extending protrusions 30, 32 may deform and/or deflect when the engaging members 26, 28 are inserted into and withdrawn from the recesses 20, 22. As shown in the accompanying figures, the protrusions 30, 32 may be disposed in or at least positioned proximate to the receiving portions 18 and the recesses 20, 22. It will be understood, however, that the protrusions 30, 32 may be positioned in other suitable locations depending, for example, upon the size and configuration of the panels 12 and/or attachment members 14.

In further detail, the base 24 of the attachment member 14 may include a body 34 and the engaging member 26 may be disposed at a first end 38 of the body and the engaging member 28 may be disposed proximate a second end 42 of the body. The body 34 of the base 24 may also include a central portion 40 disposed between the first and second ends 38, 42. The engaging member 28 is preferably a flexible member that may be moved from its original position when the attachment member 14 is being attached to a panel 12, but then the engaging member may resiliently return towards its original position when the attachment member 14 is attached to the panel. The engaging member 28 is preferably constructed from a resilient material, such as spring steel, but it may be constructed from other materials with suitable characteristics.

As shown in FIGS. 5-7, when the engaging member 26 is inserted into the recess 20 of a first receiving portion 18, the base 24 may pivot or swing downwardly to allow the engaging member 28 to be inserted into the recess 22 of a second receiving portion 18. When the engaging member 28 is inserted into the recess 22, the engaging members 26, 28, the protrusions 30, 32 and/or the body 34 of the attachment member 14 may deform and/or deflect.

The deformation and/or deflection may facilitate attachment of the attachment member 14 to the panel 12. In addition, this deflection and deformation may help provide a more snug fit between the attachment member 14 and the first and second receiving portions 18 in the panel 12. In addition, when the engaging members 26, 28 are disposed in the first and second receiving portions 18, at least some of the deformed and/or deflected portions of the panel 12 and/or the attachment member 14 may remain deformed and/or deflected in some amount, which may help provide a tension or force that assists in securing the attachment member to the panel. For example, the engaging member 28 may remain at least partially deformed, deflected and/or compressed and that may create a force against the recess 22, protrusion 32 and/or the second receiving portion 18. Moreover, the engaging members 26, 28 are disposed in the first and second receiving portions 18, such as shown in FIG. 7, the second end 42 of the body 34 of the base 24 may contact, abut and/or engage a front portion 44 of the panel 12, which may even further secure the attachment member 14 to the panel using, for example, a friction fit.

As shown in the accompanying figures, the upper end 38 of the base 24 may be inserted into a first receiving portion 18 and the lower end 42 of the base may be disposed proximate a second receiving portion. In this exemplary configuration, the first receiving portion 18 is disposed above the second receiving portion. In this configuration, the engaging member 28 may exert a force against the recess 22 and/or protrusion 32 of the second receiving portion 18, and this may drive the engaging member 26 upward and into the recess 20 in the first receiving portion 18. Advantageously, this may allow the attachment member 14 to be securely attached to the panel 12 because the engaging member 26 may be securely disposed in the recess 20 and the engaging member 28 may be securely attached to the second receiving portion.

In greater detail, when the attachment member 14 is attached to the panel 12, a generally upward force may help position maintain the engaging member 26 within the recess 20. In addition, a generally downward force may help maintain the engaging member 28 in the recess 22. These generally opposing forces may help securely attach the attachment member 14 to the panel 12.

It will be appreciated that the panel 12 and attachment member 14 may have other suitable configurations and arrangements. For example, the base 24 could be positioned in an opposite orientation in which the first end 38 may be a lower end, the second end 42 may be an upper end and the engaging member 28 may be positioned above the engaging member 26. In such an orientation, the engaging member 28 may exert a force against the recess 22 and the second receiving portion 18 to drive the engaging member 26 downward into the recess 20 of the first receiving portion 18. Thus, it will be understood that the panel 12 and the attachment member 14 may have different configurations and arrangements depending, for example, upon the intended use of the system 10.

In order to connect the attachment member 14 to the panel 12, a first portion of the attachment member 14 may be inserted or snapped into a first receiving portion 18. A second portion of the attachment member 14 may be inserted or snapped into a second receiving portion 18. In particular, a first engaging portion 26 may be inserted into a first receiving portion 18 and a second engaging portion 28 may be inserted into a second receiving portion.

In order to disconnect the attachment member 14, the engaging portion 28 of the second portion of the attachment member 14 may be withdrawn out of the second receiving portion 18. The engaging portion 26 of the attachment member 14 may then be withdrawn from the first receiving portion 18. Because the attachment member 14 may be quickly and easily connected and disconnected from the panel 14, this may allow the system 10 to be easily used in a wide variety of environments.

In addition, the system 10 may be used in a wide variety of locations because the size and configuration of the system may be easily changed and adjusted. For instance, multiple panels 12 may be connected together to form a wall 13 (see FIG. 8). This may allow, for example, a first panel 12 to include a first receiving portion 18 that receives a first portion of the attachment member 14 and a second panel to include a second receiving portion 18 that receives a second portion of the attachment member. Thus, a single attachment member 14 may be connected to two or more panels, if desired.

The panels 12 may have different sizes and configurations, which may allow walls of different sizes to be created. The panels 12 may also include multiple receiving portions 18, which may allow multiple attachment members 14 to be attached to a given panel. In addition, the receiving portions 18 preferably extend across the entire width of the panels 12 and the receiving portions are preferably spaced a constant distance apart. Additionally, the panels 12 may have the same shape, size, configuration and arrangement, which may allow the panels to be interchanged. The interchangeable panels 12 may facilitate manufacturing, shipping, storage and use of the system 10. The panels 12, however, could have other suitable shapes, sizes, configurations and arrangements depending, for example, upon the intended use of the system 10.

For example, the receiving portions 18 of the panel 12 and the engaging portions 26, 28 of the attachment member 14 may have different shapes, sizes, configurations and arrangements. An exemplary embodiment of the panel 12 and attachment member 14 is described in more detail below. It will be understood, however, that the panels 12 and attachment members 14 may have other suitable shapes, sizes, configurations and arrangements.

For example, as shown in FIG. 1, the recess 20 of the receiving portions 18 may be disposed at an angle relative to the front portion 44 of the panel 12. In some instances, the recess 20 may be disposed between an angle of about 40 degrees and about 50 degrees, or between about 35 degrees and about 55 degrees relative to the front portion 44 of the panel 12. The recess 20 may also be disposed at about a 45 degree angle relative to the front 44 of the panel 12. The first end 38 of the body 34 may be angled rearward at about a 40 to 50 degree angle, or about a 35 to 55 degree angle, and preferably about a 45 degree angle. The angled recess 20 and/or the angled end 38 may help provide a more secure connection between the attachment member 14 and the panel 12. The recess 20 and the end 38 may be disposed at greater or lesser angles, if desired. The end 38, however, need not be angled as shown in FIGS. 5-7. Moreover, the recess 20 need not be disposed at an angle relative to the front 44 of the panel 12 and could be parallel to the front of the panel, if desired.

Figure 4:
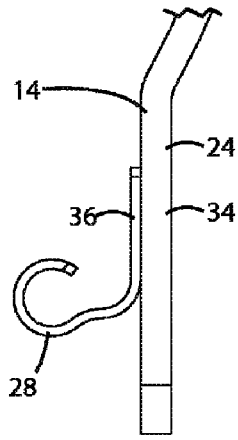
FIG. 4 is an enlarged side view of a portion of the attachment member shown in FIG. 1.

As shown in FIG. 4, the engaging member 28 may include a spring-like member 36 that has a generally curvilinear shape with an open end. As shown in FIG. 7, a curved portion of the spring may contact, abut and/or engage the recess 22 of the receiving portion 18 to help retain the attachment member 14 using a snap, friction and/or interference fit. If desired, the open end and/or other portions of the spring 36 may contact, abut and/or engage any part of the receiving portion 18 to help retain the attachment member 14 using a snap, friction and/or interference fit. It will be appreciated that the spring 36 does not require a generally curvilinear shape and that the spring may have a variety of other suitable sizes, shapes and/or configurations.

Figure 2:
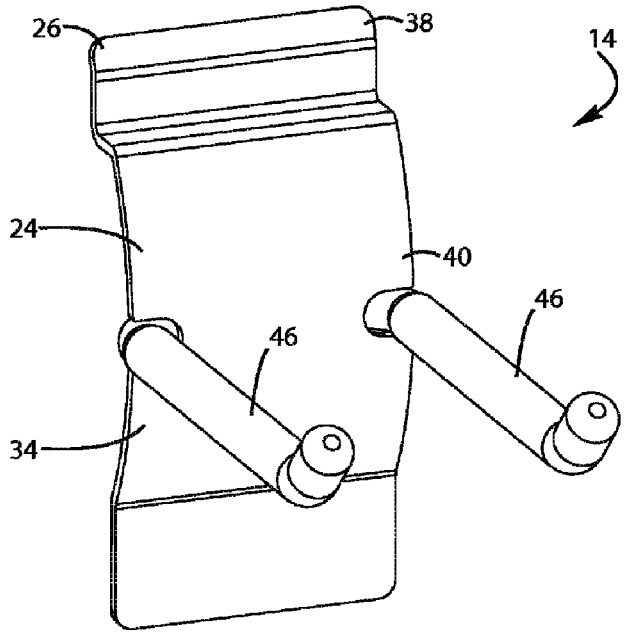
FIG. 2 is a front perspective view of the attachment member shown in FIG. 1.

As shown in the accompanying figures, the attachment members 14 may include one or more supports that may be sized and configured to support, store and/or organize items. For example, as shown in FIG. 2, the exemplary attachment member 14 may include one or more elongated arms 46 that may be sized and configured to support, store and/or organize items. In another example shown in FIG. 8, an attachment member 48 may include or support a shelf 50, and the shelf may be sized and configured to support, store and/or organize items. The attachment members may include a base to which the supports may be connected and/or from which the supports may extend outwardly. For example, the arms 46 may be connected to and/or extend outwardly from a base 24, and the shelf 50 may be connected to and/or extend outwardly from a base 24. If desired, the supports may be cantilevered, although this is not required. The attachment members may also include other structures such as hooks, braces, brackets, straps, clamps, clasps, hangers, racks, baskets, bins, cabinets, shelves, rack-and-ball holders, bicycle hooks, golf-bag holders and the like. It will be appreciated that the supports may have any of a variety of suitable sizes, shapes and/or configurations.

Figure 3:
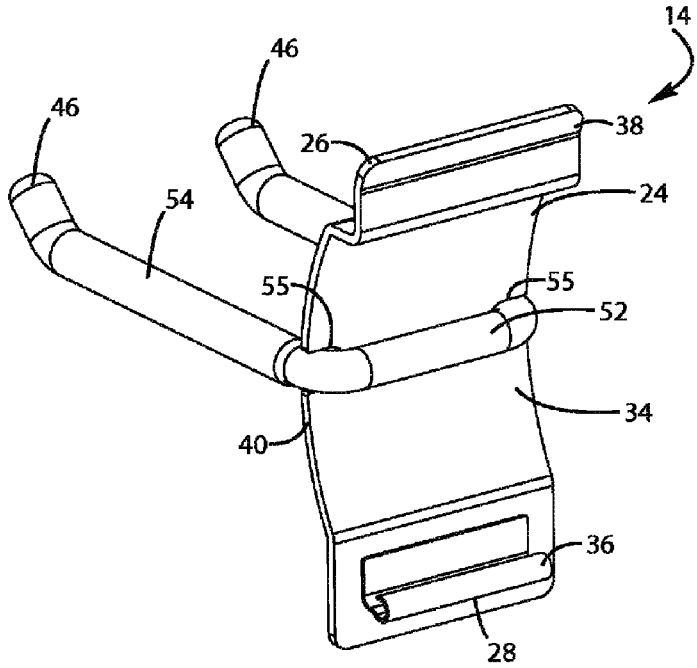
FIG. 3 is a rear perspective view of the attachment member shown in FIG. 1.

As best seen in FIGS. 2-3, the attachment member 14 may include a pair of arms 46 and an intermediate portion 52 that may be connected to the arms to interconnect the arms. The arms 46 and the portion 52 may form at least a portion of a generally U-shaped structure 54. The arms 46 and/or other portions of the structure 54 may extend through and/or engage openings formed in the base 24, for instance, notches 55 formed in the body 34.

If desired, the base 24, the body 34, the spring 36, the arms 46, the intermediate portion 52 and/or the structure 54 may be constructed from relatively strong and sturdy materials such as metal or steel, and the engaging portion 28 may be welded to the body 34. It will be appreciated, however, that the base 24, the body 34, the spring 36, the arms 46, the intermediate portion 52 and/or the structure 54 may be constructed from other suitable materials and that the body may be connected to the spring and/or the structure 54 using one or more fasteners, welds, connectors, adhesives and/or any other suitable means. Moreover, the spring 36 and/or the arms 46 may be integrally formed with the body 34 as part of a unitary, one-piece base 24, if desired.

As shown in FIG. 8, a cabinet 56 may be attached to one or more panels 12. For example, the cabinet 56 may be attached to the attachment member 48 and the shelf 50 may form part of a lower wall 58 of the cabinet. The cabinet 56 preferably includes the lower wall 58, an upper wall 60 and a pair of side walls 62. The cabinet 56 may also include one or more doors 64, which may be pivotally connected to one or more of the walls 58, 60, 62 using one or more hinges 66 or other suitable means. The doors 64 may be lockable. For instance, the cabinet 56 may include one or more locks that may be used to lock the doors 64 in a closed position.

Significantly, the cabinet 56 does not require a rear wall. For example, the cabinet 56 may have an open-ended rear 68 that may contact, abut and/or engage the wall or panels 12. This may allow at least a part of one or more of the receiving portions 18 of the wall or panels 12 to be exposed and accessible, for instance, when the doors 64 of the cabinet are open. Consequently, when the doors 64 of the cabinet are open, one or more attachment members may be selectively connected to and/or disconnected from the exposed, accessible receiving portions 18. This may advantageously help avoid wasting the portions of the wall or panels 12 behind the cabinet 56. Moreover, this may advantageously allow the cabinet 56 to house virtually limitless combinations and arrangements of attachments members having various supports, such as hooks, braces, brackets, straps, clamps, clasps, hangers, racks, baskets, bins, cabinets, shelves, rack-and-ball holders, bicycle hooks, golf-bag holders and other types of supports.

The cabinet 56 does not require the doors 64 and could have an open-ended rear 68 and an open-ended front to provide a box frame that may be selectively connected to and/or disconnected from the wall or panels 12. It will be appreciated that the cabinet 56 does not require an open-end rear and could have a rear wall, if desired.

Desirably, attachment members (such as the attachment member 14 and/or the cabinet 56) may be selectively connected to and/or disconnected from a variety of different types structures, including but not limited to, walls (such as slat walls), peg boards, and/or other suitable types of structures. The peg boards may include, for example, a panel that may include openings arranged in a predetermined pattern of one or more generally aligned rows and/or columns.

As shown in FIG. 1, the receiving portions 16, 18 may be elongated and may extend along all or at least a substantial portion of the length of the panel 12. The receiving portions 16 may be parallel or at least substantially parallel and may be spaced apart at a generally constant distance, which may allow panels 12 to be interconnected in various arrangements. The receiving portions 18 may also parallel or at least substantially parallel and may be spaced apart at a generally constant distance, which may allow the attachment members 14 to the panel 12 in virtually limitless arrangements.

In some embodiments, the panel 12 may be molded and the receiving portions 16, 18, the recesses 20, 22, and/or the lips or protrusions 30, 32 may be integrally formed in the panel as part of a unitary, one-piece structure during the molding process, for instance, during an extrusion or other molding process. Significantly, the integrally-molded receiving portions 16, 18, recesses 20, 22, and lips or protrusions 30, 32 may be quickly and easily formed during the molding process, thus helping to decrease manufacturing costs. It will be appreciated, however, that the receiving portions 16, 18, the recesses 20, 22, and/or the lips or protrusions 30, 32 may be formed using a molding process, a milling process, or other suitable manufacturing processes.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A storage and organization system comprising:

a wall having a front surface, a rear surface, and first and second elongated receiving portions extending into the front surface, each of the first and second elongated receiving portions being defined by an upper surface and a lower surface;

an attachment member sized and configured to be connected to and disconnected from the wall, the attachment member comprising:

a base comprising:

a body having a first end, a second end, and a central portion extending between the first and second ends, wherein:

the first end of the body includes first engaging portion sized and configured to be inserted into the first elongated receiving portion such that an upper end of the first engaging portion abuts against the upper surface of the first elongated receiving portion so as to prevent upward movement of the attachment member relative to the wall when the attachment member is secured to the wall; and the second end of the body is generally planar and is sized and configured to extend in front of and beyond the second elongated receiving portion when the attachment member is secured to the wall; and a spring secured to a back surface of the body, the spring including a second engaging portion extending away from the body, the second engaging portion of the spring being sized and configured to be inserted into the second elongated receiving portion such that the second engaging portion engages the lower surface of said second elongated receiving portion using a snap fit so as to prevent downward movement of the attachment member relative to the wall when the attachment member is secured to the wall; and a support connected to the base.

2. The storage and organization system as in claim 1, wherein the wall further includes a receiving portion extending into the rear surface, the receiving portion being sized and configured to receive an alignment member configured to align two or more panels together to form the wall.

3. The storage and organization system as in claim 1, wherein the spring is spaced apart from and positioned between the first and second ends of the body.

4. The storage and organization system as in claim 1, wherein the support includes a generally U-shaped structure comprising:

a first elongated arm that extends away from the base;

a second elongated arm that extends away from the base; and an intermediate portion extending between the first and second elongated arms;

wherein:

the body of the base further includes a first notch and a second notch, at least a portion of the generally U-shaped structure extends through the first notch in the body of the base, and at least a portion of the generally U-shaped structure extends through the second notch in the body of the base.

5. The storage and organization system as in claim 1, wherein the support includes a generally U-shaped structure comprising:

a first elongated arm that extends away from the base;

a second elongated arm that extends away from the base; and an intermediate portion extending between the first and second elongated arms;

wherein:

the body of the base further includes a first opening and a second opening, at least a portion of the generally U-shaped structure extends through the first opening in the body of the base, and at least a portion of the generally U-shaped structure extends through the second opening in the body of the base.

6. The storage and organization system as in claim 1, wherein the support forms part of a cabinet that comprises:

a first side wall;

a second side wall;

an upper wall;

a lower wall; and an open-ended rear that is sized and configured to abut the wall that includes the first elongated receiving portion and the second elongated receiving portion.

7. The storage and organization system as in claim 1, wherein the wall comprises:

a first panel that includes the first elongated receiving portion; and a second panel that includes the second elongated receiving portion.

8. The storage and organization system as in claim 1, wherein the wall comprises a panel that includes the first and second elongated receiving portions.

9. The storage and organization system as in claim 8, wherein the panel is constructed from PVC using an extrusion molding process; and wherein the first and second elongated receiving portions are integrally formed in the panel as part of a unitary, one-piece structure during the extrusion molding process.

10. The storage and organization system as in claim 8, wherein the panel is constructed using an extrusion molding process; and wherein the first and second elongated receiving portions are integrally formed in the panel as part of a unitary, one-piece structure during the extrusion molding process.

11. A storage and organization system comprising:

at least one panel comprising:

a front surface;

a first elongated receiving portion including a recess oriented at an angle between about thirty-five degrees and about fifty-five degrees relative to the front surface, a first protrusion extending between the recess and the front surface, a second protrusion extending into the first elongated receiving portion, wherein a distance between the first and second protrusions define an opening of the first elongated receiving portion, and a second elongated receiving portion; and an attachment member comprising:

a body having a first end, a second end, and a central portion extending between the first and second ends, and a spring secured to a back surface of the body, the spring including an engaging portion sized and configured to be inserted into and retained by the second elongated receiving portion using a snap fit when the attachment member is secured to the at least one panel;

wherein:

the first end of the body includes an engaging portion sized and configured to be inserted entirely into and retained by the first elongated receiving portion, an upper end of the first end of the body abuts against an upper surface of the first elongated receiving portion so as to prevent upward movement of the attachment member relative to the wall when the attachment member is secured to the at least one panel, and the first engaging portion has a length greater than the distance defining the opening of the first elongated receiving portion.

12. The storage and organization system as in claim 11, wherein the engaging portion of the first end of the body of the attachment member is compressed between the first and second protrusions when the attachment member is secured to the at least one panel.

13. A storage and organization system comprising:

one or more panels comprising:

a first elongated receiving portion and a second elongated receiving portion, the second elongated receiving portion being at least substantially parallel to the first elongated receiving portion, each of the first and second elongated receiving portions being defined by an upper surface and a lower surface;

an attachment member sized and configured to be connected to and disconnected from the one or more panels, the attachment member comprising:

a base comprising:

a body having a first end and a second end;

a first engaging portion secured to the first end and extending generally parallel to and away from the body, the first engaging portion being sized and configured to be inserted into and retained by the first elongated receiving portion such that an upper end of the first engaging portion contacts the upper surface of the first elongated receiving portion; and a second engaging portion secured proximate the second end of the body, the second engaging portion being sized and configured to be inserted into and retained by second elongated receiving portion using a snap fit, the second engaging portion extending from a back surface of the base, and the second engaging portion having a generally curvilinear shape with an open end facing the first end of the body, wherein a bottom surface of the generally curvilinear shape of the second engaging portion engages the bottom surface of the second elongated receiving portion so as to prevent downward movement of the attachment member relative to the wall when the attachment member is secured to the wall; and a support connected to the base.

14. The storage and organization system as in claim 13, wherein the one or more panels include a front and a rear; and wherein the first elongated receiving portion includes a recess that is sized and configured to receive and retain the first engaging portion using an interference fit, the recess being disposed at an angle that is between about thirty-five degrees to about fifty-five degrees relative to the front of the one or more panels.

15. The storage and organization system as in claim 13, wherein the one or more panels include a front and a rear; and wherein the first elongated receiving portion includes a recess that is sized and configured to receive and retain the first engaging portion using an interference fit, the recess being disposed at an angle that is between about forty degrees to about fifty degrees relative to the front of the one or more panels.

16. The storage and organization system as in claim 13, wherein the one or more panels include a front and a rear; and wherein the first elongated receiving portion includes a recess that is sized and configured to receive and retain the first engaging portion using an interference fit, the recess being disposed at an angle that is about forty-five degrees relative to the front of the one or more panels.

17. The storage and organization system as in claim 13, wherein the one or more panels comprises:

a first panel that includes the first elongated receiving portion; and a second panel that includes the second elongated receiving portion.

18. The storage and organization system as in claim 13, wherein the one or more panels comprises a first panel that includes the first and second elongated receiving portions.

19. The storage and organization system as in claim 13, wherein the support forms part of a cabinet that comprises:

a first side wall;

a second side wall;

an upper wall;

a lower wall; and an open-ended rear that is sized and configured to abut the at least one panel.

* * * * *